United States Patent [19]

Kitagawa et al.

[11] 4,307,957

[45] Dec. 29, 1981

[54] PAPER JAM DETECTING DEVICE FOR USE IN AN ELECTROPHOTOGRAPHIC COPYING MACHINE

[75] Inventors: Tsuneo Kitagawa, Toyohashi; Kenichi Arai, Nakano; Kenji Shibazaki, Aichi; Tomoji Murata, Toyokawa; Kenzo Nagata, Okazaki, all of Japan

[73] Assignee: Minolta Camera Kabushiki Kaisha, Osaka, Japan

[21] Appl. No.: 145,250

[22] Filed: Apr. 30, 1980

Related U.S. Application Data

[63] Continuation of Ser. No. 28,322, Apr. 9, 1979, abandoned.

[30] Foreign Application Priority Data

Apr. 11, 1978 [JP] Japan ..... 53/42937

[51] Int. Cl.[3] ..... G03G 15/00

[52] U.S. Cl. ..... 355/14 R; 271/258

[58] Field of Search ..... 355/14 R, 3 R, 3 SH; 271/258, 259, 263

[56] References Cited

U.S. PATENT DOCUMENTS

| | | | |
|---|---|---|---|
| 3,693,969 | 9/1972 | Sakamaki et al. | 355/14 R |
| 3,734,604 | 5/1973 | Szostak et al. | 355/14 R |
| 3,833,896 | 9/1974 | Suzuki | 271/258 X |
| 3,859,649 | 1/1975 | Slack | 355/14 R |
| 3,878,540 | 4/1975 | Kawai | 355/14 R |
| 3,944,794 | 3/1976 | Reehig et al. | 355/14 R |
| 3,948,510 | 4/1976 | Iwamoto et al. | 271/258 |
| 3,948,586 | 4/1976 | Komori et al. | 355/14 R |
| 4,084,900 | 4/1978 | Yamaoka et al. | 271/258 X |

*Primary Examiner*—Richard L. Moses

*Attorney, Agent, or Firm*—Wenderoth, Lind & Ponack

[57] ABSTRACT

This invention is directed to a paper jam detecting device for use in an electrophotographic copying machine which comprises a plurality of paper detector located along the passage of the copy paper transported during copying process, first timer adapted to count the first period of time so as to detect the leading edge of the copy paper by any one of the paper detector and second timer adapted to count the second period of time so as to detect the trailing edge of the copy paper by said one of the paper detector, whereby paper jam can be detected in case where no paper is detected on the first period of time or in case where a paper is detected on the second period of time.

7 Claims, 12 Drawing Figures

| Fig. 11A | Fig. 11B |
|---|---|

PAPER JAM DETECTING DEVICE FOR USE IN AN ELECTROPHOTOGRAPHIC COPYING MACHINE

This is a continuation of application Ser. No. 28,322, filed Apr. 9, 1979, now abandoned.

FIELD OF THE INVENTION

The present invention relates to an electrophotographic copying machine, and more particularly, to a device for detecting jamming of copy material such as copy paper jammed in the copying machine, said device comprising digital type timer means.

BACKGROUND OF THE INVENTION

In an electrophotographic copying machine, each of the sheets of copy paper on which images of an original are made is transported along a predetermined path through various stations such as feeding rollers, transfer charges, a photoreceptor drum, heat rollers and so on.

During the time the copy paper is being transported through the various stations, the copy paper may be caught at some places in the stations so that the copy paper may become jammed in the copying machine.

One conventional jam detecting device for detecting such jams employs one or more paper detecting devices disposed at the various stations as described above so as to detect the travelling copy paper and timer means for defining the periods of operation of each of the detecting devices corresponding to the positions at which each of the detecting devices is located. In such device, each of the paper detecting devices acts to detect whether or not the leading edge of a sheet of copy paper passes through a predetermined position in a given period in response to instructions fed from the timer means, thereby detecting normal transportation of a sheet of copy paper by a signal from the paper detecting device showing the passage of the sheet of copy paper.

However, in a conventional paper jam detecting device as described above, where a sheet of copy paper is jammed immediately after one paper detecting device has detected the passage of the leading edge of the copy paper, only the other paper detecting device disposed downstream of said one paper detecting device can detect said paper jam.

Therefore, the conventional paper jam detecting device has the disadvantages that the position where a copy paper is jammed can not be detected accurately and the detection of the paper jam is undesirably delayed since it requires a long time before the other paper detecting device disposed downstream detects said paper jam.

In order to avoid such disadvantages as described above, there could be provided an arrangement in which a larger number of the paper detecting devices are located with a shorter distance between two paper detecting devices adjacently disposed. In such an arrangement, it would be necessary to provide a lot of electromagnetic timers to define the operation periods of the respective paper detecting devices. However, the provision of a lot of timers requires a lot of space and it becomes troublesome not only to set the respective timers for different periods of time, but also to maintain them.

In addition, in order to avoid occurrence of errors in detecting the paper jam, each of the timers must operate in synchronism with the motions of the drive mechanism of the paper feeding device, thereby making it difficult to make the paper jam detecting device.

Another paper jam detecting device is disclosed in U.S. Pat. No. 4,084,900 wherein a timer is adapted to start counting time with respect to the trailing edge of a sheet of copy paper travelling in a predetermined path, while a paper detecting device is provided in the vicinity of the paper discharge chute of the copying machine so as to detect the sheet of passage of the trailing edge of the copy paper, whereby a jam detecting signal can be obtained from the paper detecting device if no paper is detected within the period of time counted by said timer. In this arrangement, the disadvantage inherent in the device for detecting the leading edge of a sheet of copy paper can be eliminated.

In this jam detecting device, however, it is necessary to provide a timer for counting a long period of time, which is expensive, and it takes long time before the paper jam is detected since the timer is adapted to start counting of time in response to the operation of the cutting device for cutting a roll paper and to continue counting of time until the leading edge of a sheet of copying paper passes the discharge chute.

A paper jam detecting device is also disclosed in U.S. Pat,. No. 3,833,896 wherein a sheet of copy paper is detected by means of a detecting switch MS disposed near the paper discharge chute of a copying machine. In this paper jam detecting device, a first period is set in the first timer in synchronization with the leading edge of the sheet of copy paper and a paper jam is detected if the leading edge of the copy paper does not reach the paper detecting device within said first period.

In turn the second timer is adapted to start when the leading edge of the sheet of copy paper reaches the switch SM within the first period, whereby a paper jam is detected if no copy paper passes the switch MS before the second timer completes the counting of the period time assigned thereto.

However, this paper jam detecting device also has a problem in practical use that it takes a long time, 5 minutes for example, to detect a paper jam after feed of the copy paper begins, since the copy paper is detected only by the detecting member located near the paper discharge chute.

In addition, the second timer must be set for a period of time corresponding to the largest size of the copy paper used in the copying machine in which various sizes of sheets of copy paper are available, so that much time is lost when a short sheet of copy paper is used.

OBJECTS OF THE INVENTION

Accordingly, an essential object of the present invention is to provide an improved jam detecting device which is capable of detecting a paper jam rapidly.

Another object of the present invention is to provide an improved jam detecting device which is capable of detecting positions where copy paper is jammed accurately regardless of the size of the sheet of copying paper.

A further object of the present invention is to provide a jam detecting device which comprises timer means for defining the timing of the operation of a paper detecting device for detecting a paper jam, and in which the period of time assigned to said timer can be automatically varied corresponding to the size of the sheet of copying paper.

DETAILED DESCRIPTION OF THE INVENTION

Figure 1:
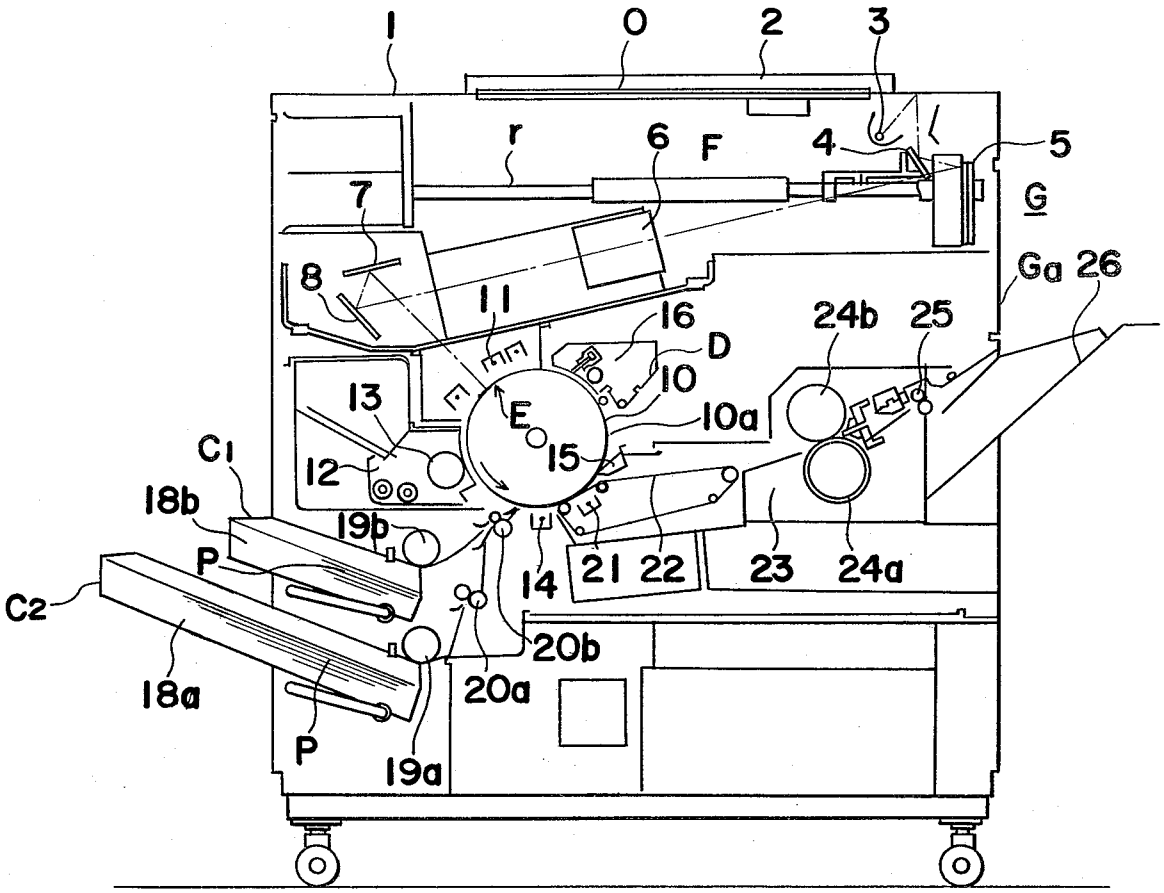
FIG. 1 is a schematic diagram showing an embodiment of a copying machine in which a paper jam detecting device according to the present invention is employed.

Referring now to the drawings, there is shown in FIG. 1 a slit exposure scanning type electrophotographic copying machine utilizing a toner powder image transfer method.

In FIG. 1, the copying machine G generally includes a housing Ga of rectangular box-like configuration defined by walls, and a photosensitive member or photoreceptor drum 10 of known construction having a photoconductive photoreceptor surface 10*a* provided on the outer periphery thereof and rotatably disposed at approximately the central portion of the housing Ga for rotation in the direction of the arrow to cause the photoreceptor surface 10*a* to sequentially pass various processing stations disposed therearound for image formation, such as a charging station with a corona charger 11, an exposure station E, a developing station having a magnetic brush type developing device 12 including a developing sleeve 13, a transfer station having a transfer charger 14, a charge erasing station provided with an AC discharger 21, a copy paper sheet separating station with a separating claw 15, a cleaning station D having a cleaning unit 16, etc. As the photoreceptor drum 10 rotates, the photoreceptor surface 10*a* thereof is uniformly charged to a predetermined potential by the corona charger 11, and a light image of an original O obtained through scanning of the original O by a scanning optical system F described later is projected onto the photoreceptor surface 10*a* at the exposure station E to form thereon an electrostatic latent image of the original O which is then developed into a visible toner image by the developing device 12 by the known magnetic brush method for being subsequently transferred by the transfer charger 14 onto a copy paper sheet P transported in synchronization with the development steps and thereafter the copy paper sheet P bearing the visible toner image thus transferred thereon is separated from the photoreceptor surface 10*a* by means of the AC discharger 21, separating claw 15, etc, so as to be further transported, by a transportation belt 22 movably supported by a plurality of rollers at a position subsequent to the transfer charger 14, to a fixing device 23 including a heat roller 24*a* and a pressing roller 24*b* for fixing the visible toner image onto the copy paper sheet P passing therebetween by fusing, and then, the copy paper sheet bearing the copied image is discharged through rollers 25 onto a tray 26, while residual toner remaining on the surface 10*a* of the photoreceptor drum 10 which is continuously rotating is scraped off the surface 10*a* by the cleaning unit 16 for completion of one copying cycle.

At the upper portion 1 of the housing Ga, there is provided a fixed platform 2 of light transmitting transparent plate material for supporting the original O to be copied thereon, while below and adjacent to the platform 2 is provided the scanning optical system F including a light source 3, first and second reflecting mirrors 4 and 5 and a lens assembly 6, and also fixed reflecting mirrors 7 and 8. The light source 3, first and second reflecting mirrors 4 and 5, etc. are arranged to be movable or scanned along rail member r by a scanning system driving mechanism, toward the left in FIG. 1, for optically scanning the original O supported on the platform 2, and the scanning speed is such that the second reflecting mirror 5 is moved at a speed of V/2 when the speeds of the light source 3 and the first reflecting mirror 4 are V as is known to those skilled in the art. The original O placed on the platform 2 with its reverse face directed upward is continuously subjected to light rays from the light source 3 during the scanning, and the light rays reflected from the original O, i.e. the light image of the original O are directed onto the photoreceptor surface 10*a* at the exposure station E by the first and second reflecting mirrors 4 and 5, lens assembly 6, and the third and fourth reflecting mirrors 7 and 8.

For making it possible to simultaneously stock, for example, two different sizes of copy paper sheets P, the copying machine G is provided, at the lower left portion of the housing Ga, with upper and lower cassette loading sections $C_1$ and $C_2$ respectively loaded with copy paper sheet containers or cassettes 18*a* and 18*b* in which stacks of the copy paper sheets P of different sizes are accommodated, and by selectively rotating copy paper sheet feeding rollers 19*a* and 19*b* adapted to contact the leading edges of the copy paper sheets P and provided in positions corresponding to the cassettes 18*a* and 18*b* in the counterclockwise direction in FIG. 1 through suitable means (not shown), copy paper sheets P contained in either the cassette 18*a* or the cassette 18*b* are fed one by one from the top of the stack of the copy paper sheets P toward the transfer station through corresponding guide plates and feeding rollers 20*a* and 20*b* for transferring the developed toner powder image onto the copy paper sheet P in the manner as described earlier.

Figure 2:
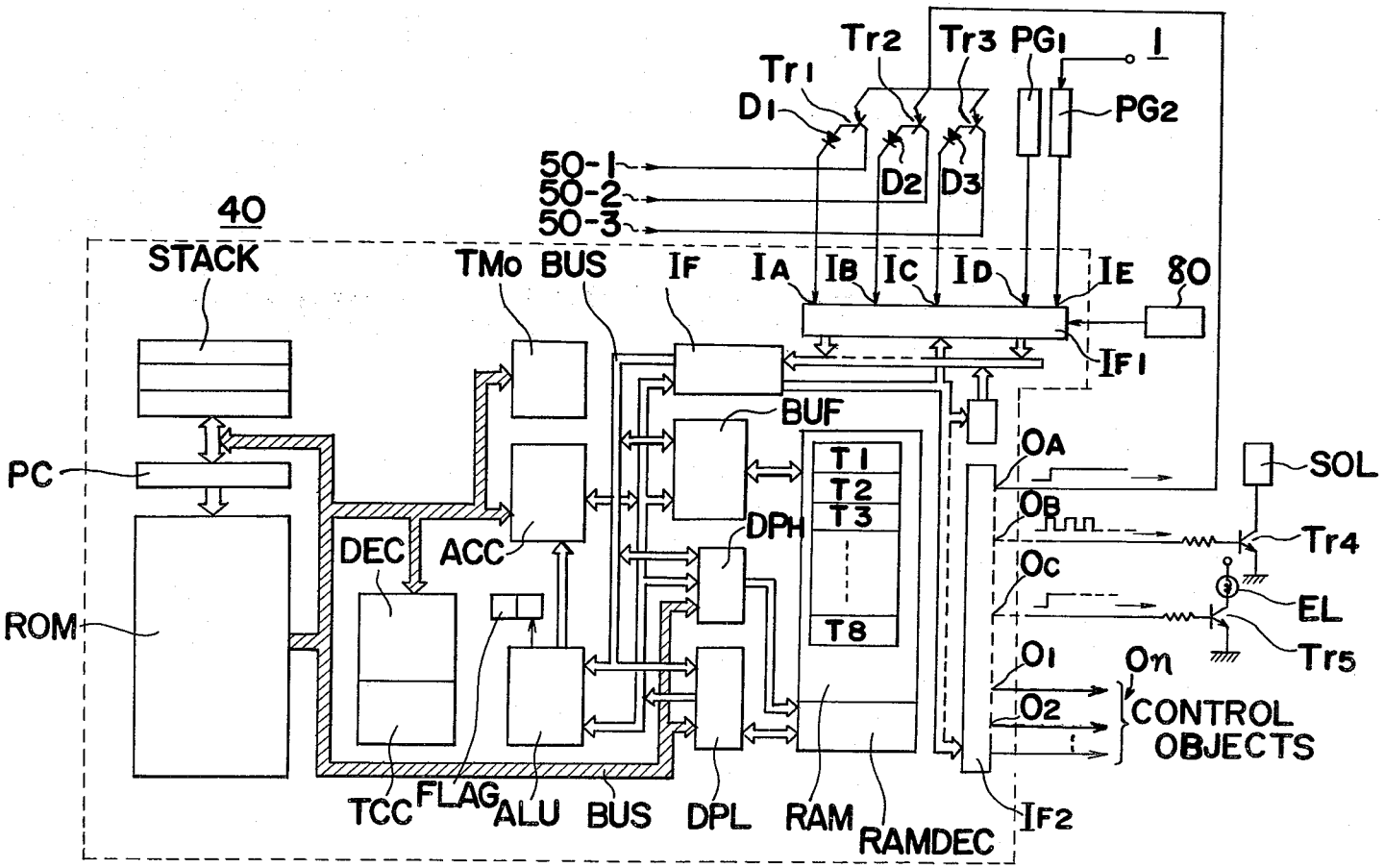
FIG. 2 is a block diagram showing an embodiment of the control circuit used for controlling the copying machine according to the present invention.

FIG. 2 shows a digital control apparatus for controlling the copying machine shown in FIG. 1 and for detecting a paper jam occurring in the machine.

Referring to FIG. 2, the digital control apparatus 40 comprises a so called microcomputer, which is composed of a central processing unit CPU, a memory portion ME and an input/output interface IF connected respectively by bus lines BUS. The central processing unit CPU is provided with a buffer BUF and pointers DPH and DPL composed of registers, the timing control portion TCC being composed of an arithmetic unit ALU, accumulators ACC, a program counter PC, a command decoder DEC, and timer circuits; the memory portion ME being composed of a random access memory RAM, a read-only memory ROM, and a stack memory STACK or the like.

Figure 4:
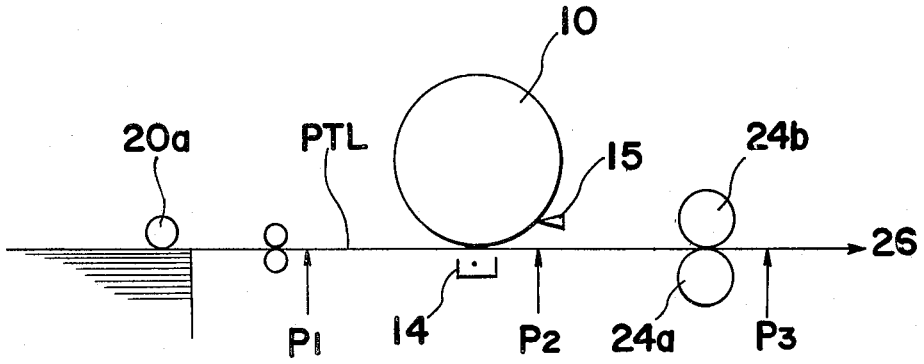
FIG. 4 is a schematic diagram showing the relationships between positions of essential components of the copying machine and positions of the paper detecting devices.

The input terminals $I_A$, $I_B$ and $I_C$ of the input/output interface IF1 are connected, respectively, to the collectors of transistors Tr1, Tr2 and Tr3 through diodes D1, D2 and D3. Each of the transistors Tr1, Tr2 and Tr3 is connected at its base to a corresponding output terminal the 50-1, 50-2 and 50-3 of the paper detector for detecting the leading edge or the trailing edge of a copy paper sheet P and at each of the emitters to an output terminal OA. Respective detectors 50-1 through 50-3 are disposed at a position P1 downstream near the paper feeding roller 20*a*, in a position P2 downstream near the photoreceptor drum 10 and in a position P3 downstream near the heat roller 24*b* as shown in FIG. 4.

Details of the construction of the paper detector will be described later.

The input terminal $I_D$ is connected to a pulse generator PG1 which generates a series of reference clock pulses at a predetermined frequency.

The input terminal $I_E$ is connected to the output terminal of a pulse generator PG2 which generates a series of pulse signals synchronized with the motion of the driving mechanism of the copying machine.

The pulse generator PG2 employed herein may be composed of a disk having a plurality of slits in the annular edge portion thereof, a photo coupler provided on both sides of the disk to receive pulses of light projected from the light source through one of the slits for generation of pulses from the photo sensitive element provided in the photo coupler. Said disk is connected with the rotary shaft for driving the paper feed rollers 19*a* or 19*b*.

The output terminal $O_B$ is connected through a transistor Tr4 with the solenoid SOL of a paper jam display device comprising a drum on the periphery of which the positions P1, P2 and P3 are displayed and which is adapted to be rotated with predetermined angular pitch by ratchet means driven by the solenoid.

The output terminal $O_C$ connects with a display lamp EL through a transistor Tr5 for indicating the fact that a paper is jammed in any one of the positions P1 through P3.

The output terminals On (n is a desired number from the set 1, 2, . . . n) are connected to the switch mechanism portions (not shown) for the various sections of the copying machine such as a heater (not shown) for the heat roller 24*b*, or the like which are operated independently of the driving mechanism for the transportation of the copy paper sheet, and the driving mechanism (a solenoid for actuating a clutch mechanism for coupling to the output shaft of the driving motor) or the like, which are specified as control objects.

Figures 11, 11A:
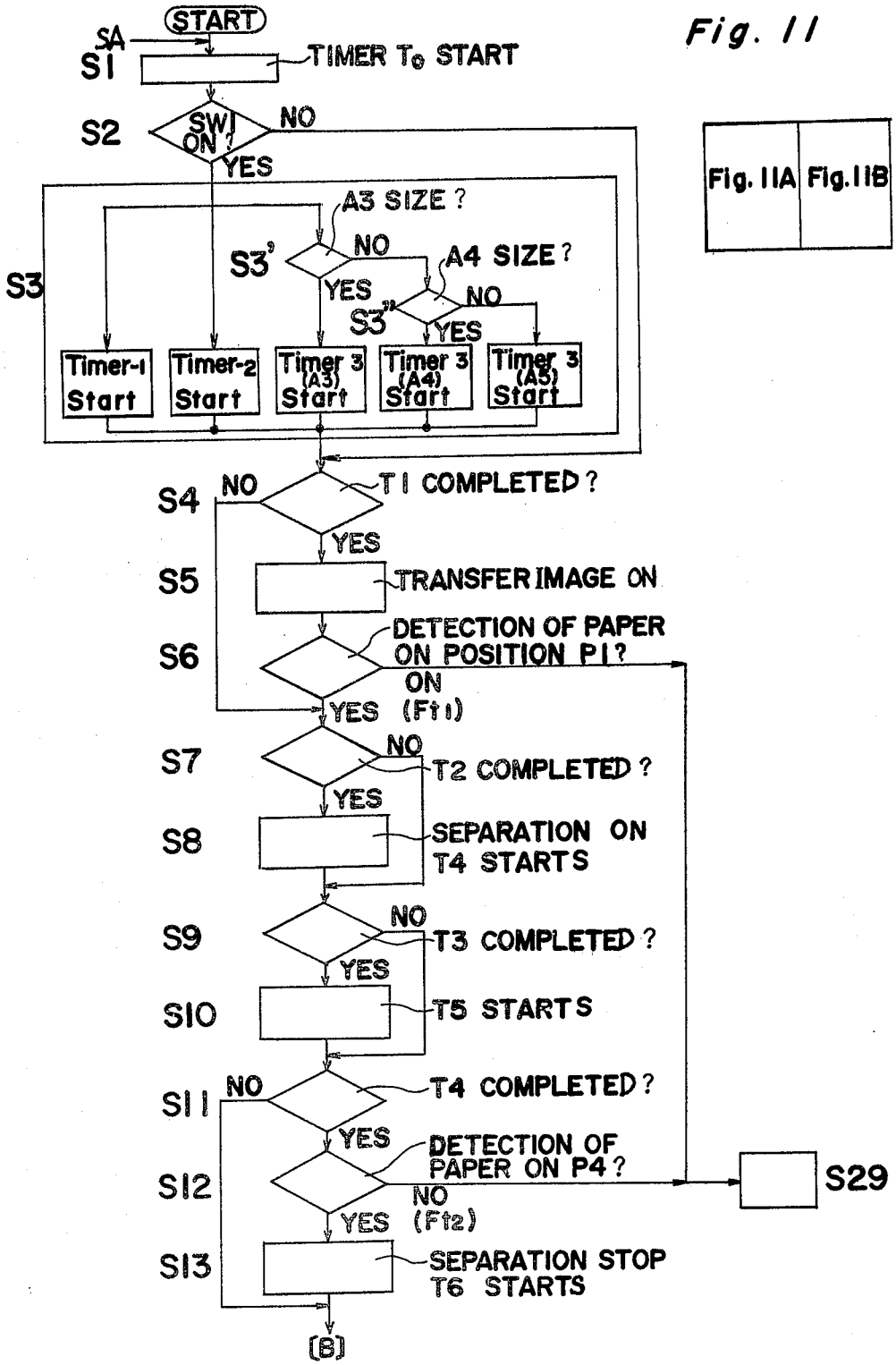
FIGS. 11A and 11B together constitute a flow chart showing the operation of the essential portion of the embodiment of the paper jam detecting device according to the present invention.

In the memory portion ME of the microcomputer, a set of control program as shown in FIG. 11 is stored so as to specify and to control sequentially each of the sections connected to the input/output terminals $I_A$, $I_B$–$O_n$ of the interfaces IF1 and IF2 in accordance with operation commands provided in the control program and being read out therefrom with predetermined timings in a known manner.

The timing control TCC determines the timing of the operation of the respective sections.

The timer TM0 of the timing control portion in the RAM suitably divides the frequency of the reference pulses fed from the generator PG1 and applies series of standard pulses to a plurality of timers T1 through T8 provided in the RAM in order to count various periods of time for definning the timing for judgement of the states of the paper detectors 50-1, 50-2 and 50-3.

Figure 5:
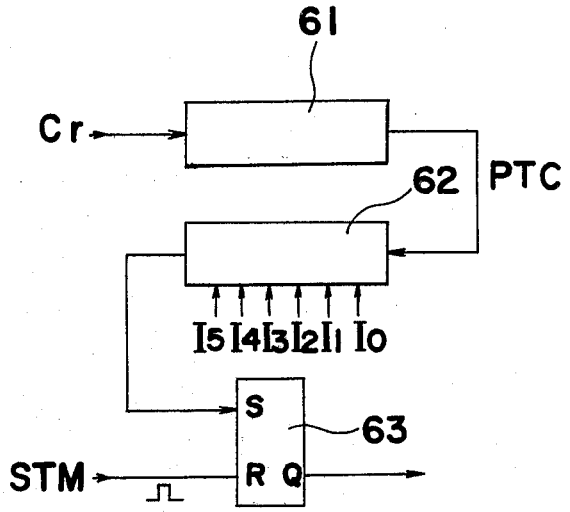
FIG. 5 is a circuit diagram of one example of timer employed in the control circuit arrangement shown in FIG. 2.

Each of the timers T1 through T8 can be a circuit represented by the circuit arrangement shown in FIG. 5, wherein a counter 61 which is, for example, a polynominal counter of six bits is provided to receive said standard pulses Cr fed from the timer TM0 for producing a series of pulses (hereinafter referred to as time counting pulses PTC). A preset counter 62 in which predetermined digital binary data indicative of a period of time to be counted is preliminarily stored is connected with said counter 61 to receive said time counting pulses PTC. The content of the preset counter 62 is decreased one by one in response to application of said time counting pulses PTC to produce a borrow signal of "1" level when said contents stored in the preset counter 62 reach negative value.

A flip-flop circuit 63 is connected to the output terminal of the preset counter 62 at its set input terminal S. Said flip-flop circuit 63 is adapted to receive a start pulse STM at its reset input terminal R. The output Q of the flip-flop circuit 63 is supplied to the interface IF for initiating the inspection of the state of the input terminals $I_A$, $I_B$ and $I_C$.

By this arrangement, digital binary data representing a period of time to be counted is preset in the preset counter 62 simultaneously with the application of the start signal STM by which the flip-flop circuit 63 is cleared, thereby causing the output Q to be "0". When said period of time has elapsed and the contents of the preset counter 62 become negative value, a borrow signal appears on the output of the preset counter 62 to set the flip-flop circuit 63. By this operation, the flip-flop circuit produces a time instruction in the form of a "1" signal showing the fact that the timer Tn (n=1, 2–8) has completed the counting of the period of time assigned to the preset counter 62. The time instruction obtained by the flip-flop circuit 63 is used as a command signal for starting the operation of the controlled section.

Figure 6:
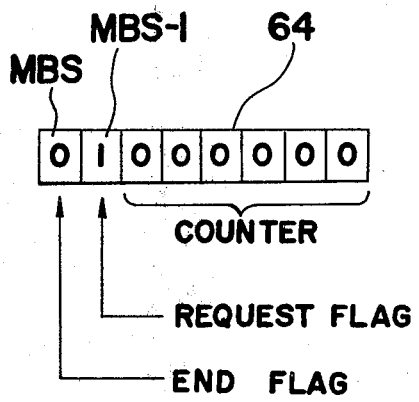
FIG. 6 is a circuit diagram of another example of a timer employed in the control circuit arrangement shown in FIG. 2.

As shown in FIG. 6, the preset counter 62 can be composed of a shift register 64 of a 8 bits. Also it is possible to provide an additional shift register at the output of the flip-flop circuit 63. Two bits of the most significant column MBS of the shift register 64 and the less significant column MBS-1 thereof are allocated respectively, as an end flag and a request flag. The digital data to be counted are stored in the remaining six bits of the register 64. The digital data may be a binary value in the form of a complement and 1 is added thereto.

In the shift register 64, "0" and "1" are set respectively as the end flag and the request flag when the digital data indicative of the period of time is preset. When the shift register 64 completes counting of the period of time, they become "1" and "0" respectively. The command signal for operating the controlled sections can be obtained by judging the variation of the states of the request flag and the end flag.

Figure 3:
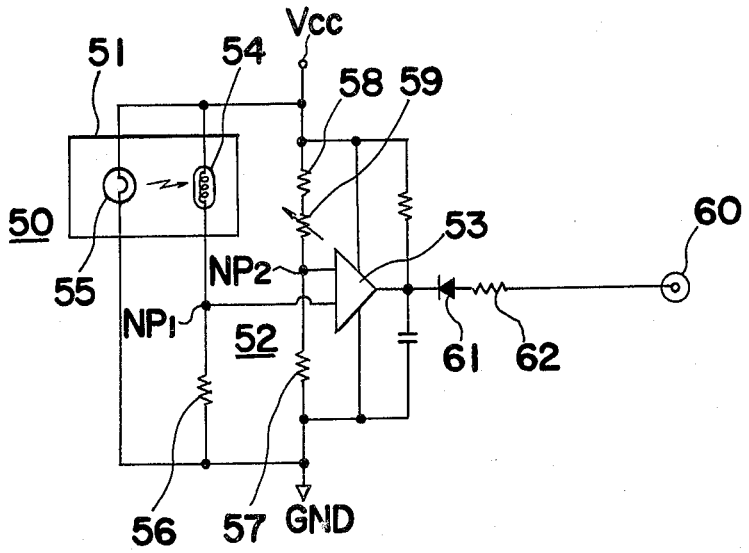
FIG. 3 is a circuit diagram showing an embodiment of a paper detecting device employed in the circuit arrangement shown in FIG. 2.

FIG. 3 shows an embodiment of the paper detector 50 employed in the copying machine described above.

The paper detector 50 is composed of a photoelectric coupler 51, a bridge circuit 52 and a comparator 53. The photoelectric coupler 51 is composed of a light sensitive element 54 made of a photoelectric element of cadmium sulfide CdS, for example, said element 54 being disposed opposite to the paper transporting path in the copying machine, and a light source 55 disposed opposite to said light sensitive element 54 for projecting a light beam against the light sensitive element 54 across the paper transporting path. The bridge circuit 52 is composed of the light sensitive element 54, resistors 56, 57 and 58 and a variable resistor 59.

The input terminals of the comparator 53 are connected with the junctions NP1 and NP2 of the bridge circuit 52 and the output terminals thereof are connected through a diode 161 and a resistor 162 to the output end 60 connected with the base of each transistor Tr1 through Tr3.

By this arrangement, when no copy paper sheet P is present between the light source 55 and light sensitive element 54, the potential difference between the joints NP1 and NP2 is low and the comparator 53 produces low level output. On the other hand, when a copying paper sheet P is present between the light source 55 and light sensitive element 54, no light is projected onto the latter 54, thus the potential difference between the joints NP1 and NP2 becomes high and the comparator 53 produces high level output. Thus the presence or absence of the copy paper sheet can be detected by sensing the level state of the output terminal 60.

Figure 7:
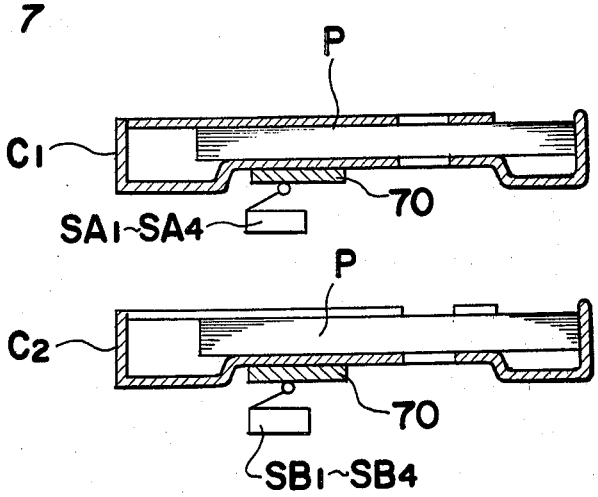
FIG. 7 is a cross sectional view of a paper size selecting device employed in the embodiment of the copying machine according to the present invention.
Figure 8:
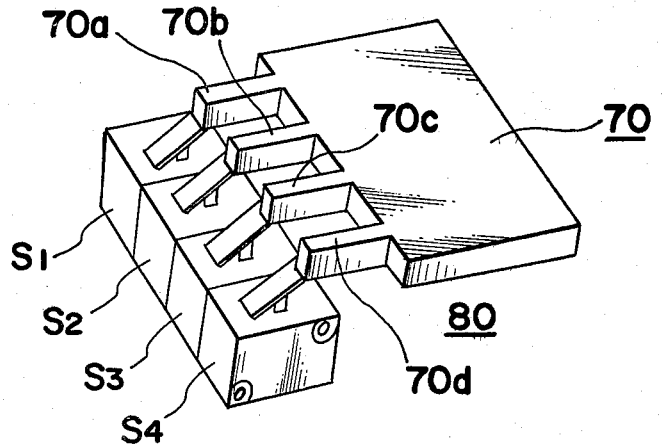
FIG. 8 is a perspective view of an essential portion of the paper size selecting device shown in FIG. 7.
Figure 9:
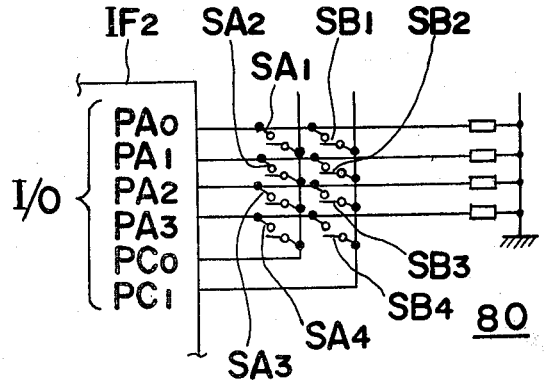
FIG. 9 is a circuit arrangement of the paper size selecting device shown in FIG. 7.

FIGS. 7, 8 and 9 show an embodiment of a paper size detecting device 80 which is used in the present invention.

As shown in FIGS. 7 and 8, each of the cassettes $C_1$ and $C_2$ is provided with a code member or actuator member 70 secured to or integrally formed with the bottom portion thereof. The code member 70 has projections, for example, four projections 70*a*, 70*b*, 70*c* and 70*d* laterally extending therefrom, and respectively arranged to contact corresponding switches for copy paper size detection provided on the side of the apparatus housing Ga and engaging the projections 70*a*-70*d* when the cassette $C_1$ or $C_2$ is loaded. The number of the projections may be reduced by suitably cutting off those not required. By way of example, if all of the four projections 70*a* to 70*d* contact the corresponding switches $S_1$ to $S_4$ to emit a signal (1111), sixteen permutations become possible including (0000), and if a different code is provided for each copy paper size, the size judgement is automatically effected upon loading of the cassette $C_1$ and $C_2$.

Referring also to FIG. 9 showing the input and output relation between the switches $S_1$ to $S_4$ and the interface IF1 of the microcomputer 40, it is assumed that the size detection is to be effected for the upper and lower cassettes $C_1$ and $C_2$ as shown in FIG. 8, with the detection switches for the upper cassette $C_1$ being designated as $SA_1$, $SA_2$, $SA_3$ and $SA_4$ and those for the lower cassettes $C_2$ as $SB_1$, $SB_2$, $SB_3$ and $SB_4$.

Detection signals are emitted from the output terminals $PC_0$ and $PC_1$ of the interface IF1 at respectively different timings, and the output from the output terminal $PC_0$ is connected to respective input terminals $PA_0$, $PA_1$, $PA_2$ and $PA_3$ through the corresponding switches $SA_1$, $SA_2$, $SA_3$ and $SA_4$, while the output from the output terminal $PC_1$ is connected to respective input terminals $PA_0$, $PA_1$, $PA_2$ and $PA_3$ through the corresponding switches $SB_1$, $SB_2$, $SB_3$ and $SB_4$, and thus, during the output period of the respective output terminals $PC_0$ and $PC_1$, the size judgement is effected by binary code of four bits by the combination of the size judging switches $SA_1$ to $SA_4$ and $SB_1$ to $SB_4$ which are respectively opened and closed.

It should be noted that, for the size detecting means for each of the copy paper sheet cassettes, various modified devices can be employed, for example, means for converting optically detectable markings printed on the cassettes in white, black, etc. into electrical signals by a photoelectric transducer element, means composed of a combination of a magnet and a lead switch, etc. Moreover, the arrangement can be such that in the absence of copy paper sheets in the cassettes loaded in the copying apparatus, the signal 0000 is emitted, by providing, apart from the copy paper size detection means described above, means for detecting the presence of the copy paper sheets including, for example, a light transmitting opening formed at a predetermined position in the cassette together with light emitting and light receiving elements.

The operation of the jam detecting device described above is set forth below.

When the copying machine starts to operate in a known manner for making a copy of an original, a switch SW1 is switched to the "ON" position by the action of the scanning device, and the timers T1 and T2 are respectively set with first and second digital data indicative of periods of time t01 and t02. The first data indicative of the period of time t01 corresponds to the time during which the leading edge of a sheet of copy paper moves from the front of the cassette C1 (or C2) to any one of the positions P1, P2 or P3. Said periods of time can be calculated by the relationship between the speed of the copy paper and the distance that the copy paper moves to a position where any one of the paper detectors 50-1, 50-2 or 50-3 are disposed respectively. On the other hand, the second data indicative of the the period of time t02 corresponds the length between the leading edge and trailing edge of a sheet of copy paper.

The second data are calculated preliminarily according to the paper size information supplied from the paper size detecting device 70 and stored in the RAM. The second data are adapted to be included in the program stored in the ROM. Furthermore, the second data can be calculated by the relationship between the various lengths of the copy paper and the speed thereof transported in the copying machine.

When a sheet of copy paper is fed to the paper path PTL from the cassette C1, said timers T1 and T2 start to count the time by counting pulses PTC fed from the counter 61. A predetermined voltage is supplied from the output terminal $O_A$ to the emitters of the transistors Tr1, Tr2 and Tr3 until a sheet of copy paper reaches the discharge tray 26.

When the timer T1 has completed the counting of the period t01, namely, the end flag becomes "1", the paper jam logic circuit JAML provided in the interface IF detects the state of the input terminals $I_A$. Assuming that the leading edge of the copy paper passes the paper detector 50-1, the light projected to the light sensitive element 54 is interrupted by the copy paper so that the bridge circuit 52 becomes unbalanced and the output of the comparator 52 becomes a low level output. In turn the low level output of the comparator 52 of the paper detector 50-1 is supplied to the base of transistor Tr1, which is made conductive, thereby causing the input terminal $I_A$ to be "1". Thus, the jam detecting logic circuit JAML judges that no paper is jammed in the position P1 or in the vicinity thereof. In such state, no output is supplied from the terminals $O_B$ and $O_C$ and the operation of the copying machine continues.

On the other hand, if the timer T1 has completed the counting of the period of time t01, and no leading edge of the sheet of copy paper is detected by the paper detector 50-1, the transistor Tr1 becomes non conductive to cause the input port $I_A$ to be "0", and the jam detecting logic circuit JAML judges that a sheet of copy paper is jammed at the position P1 or upstream thereof. In such state, outputs appear at the output terminals $O_B$ and $O_C$ so that the transistor Tr4 becomes conductive and excites the solenoid SOL to cause the display means to display the position where the jam has occurred, while the transistor Tr5 becomes conductive to illuminate the lamp EL. Also the copying machine stops.

In a case where no paper jam occurs, the timer T1 is set for the period of time t02 which corresponds to the position P2 of the paper detector 50-2 and starts the counting of the period t02, after the timer T1 has counted the time t01.

Following this operation, when the timer T2 has completed the counting of the period of time t02, the jam detecting logic circuit JAML judges the state of the input terminals $I_A$. In this step the jam detecting logic circuit JAML detects whether the trailing edge of the copy paper has passed the position P1. More specifically, when no paper is detected by the paper detector 50-1 and the state of the input terminal $I_A$ is "0", and the jam detecting logic circuit JAML judges that no paper is jammed in the position P1. If a sheet of copy paper is detected by the paper detector 50-1, the state of the input port $I_A$ is "1" and the jam detecting logic circuit JAML judges that the copy paper is jammed in the position P1.

After the timer T2 completes the counting of the period of time T02, the timer T2 is set with the period of time which is the same as set in the timer T1 and starts to count that period of time.

Following this operation, when the timer T1 has completed counting the period of time corresponding to the position P2, the jam detecting circuit JAML judges the state of the input terminal $I_B$. If the copy paper is present in the position P2 and the input port $I_B$ is "1" due to the output of the paper detector 50-2, the jam detecting logic circuit JAML judges that no paper is jammed in the position P2. On the other hand, if no paper is present in the position P2, and the state of the input terminal $I_B$ is "0" the jam detecting logic circuit JAML judges that the copy paper is jammed in the position P2.

After this operation, the timer T1 is set for the period of time corresponding to the position P3.

When the timer T2 has completed the counting of the period of time t02, the jam detecting logic circuit JAML judges whether the state of the input terminal $I_B$ is "1" or "0", and if the state is "0", namely the paper detector 50-2 detects no copy paper, the circuit JAML judges that no copy paper is jammed. On the other hand, if the state is "1", the circuit JAML judges that copy paper is jammed in the position P2.

An operation similar to that described above is performed when the timers T1 or T2 have completed the counting of the period of time, and a paper jam occuring at the position P3 can be detected.

It is noted that lengths of the operation period of the paper 50-1, 50-2 and 50-3 can be adjusted by changing the length of the pulse (end flag "1") fed to the jam detecting logic circuit JAML by means of a flip flop circuit, when the timer T1 or T2 has completed the counting of the period of time.

It is further noted that when a paper jam is detected, a predetermined number of pulses are generated at the output terminal $O_B$, and a voltage of a predetermined value is generated depending on the address of which of the input terminals $I_A$, $I_B$, $I_C$ to which an inquiry is made by the circuit JAML by means of a decoder and a pulse generator (not shown). By this arrangement, the position where a jam occurs can be displayed by driving the solenoid SOL by the corresponding number of pulses.

It is still further noted that the period of time to be set to the timers T1 and T2 is determined by selecting suitable data from the information stored in the RAM depending upon the instructions fed from paper size detecting device as shown in FIGS. 7, 8 and 9. The data to be set in the timer T2 for defining the operation period of the paper detector located farthest upstream is determined by the sum of the first numeric data and the second numeric data corresponding to the size of the copy paper detected by means of the paper size detecting device 70.

The operation of the control device shown in FIG. 2 will be explained step by step.

Figure 11B:
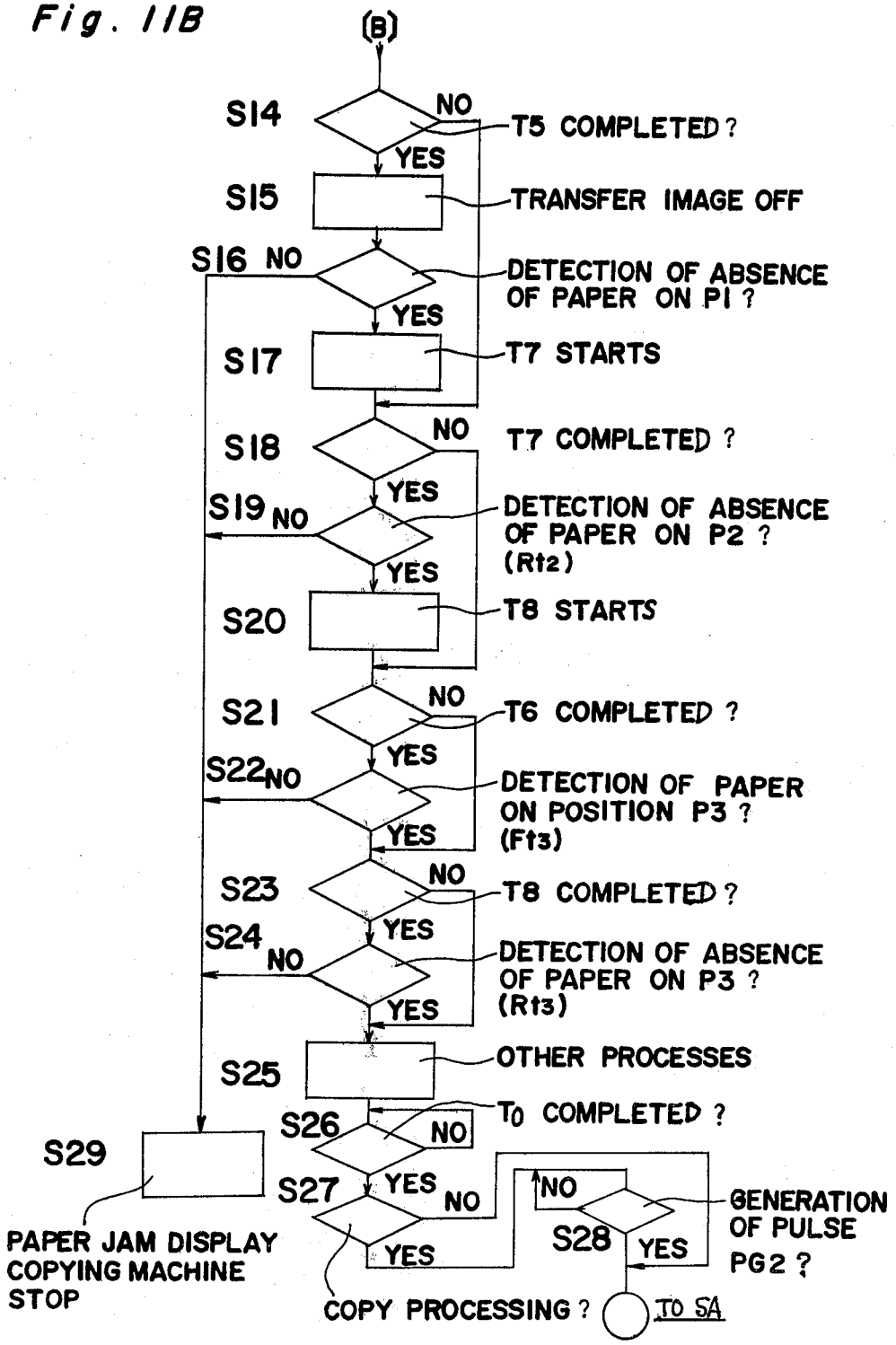

Referring to FIGS. 11A and 11B, the switch SW1 is employed for detecting the starting of the scanning of the article to be copied by the scanning mechanism provided in the copying machine. The switch SW1 is operated by the motion of the scanning mechanism F shown in FIG. 1 and is adapted to generate an ON signal which is fed to the microcomputer 40. When the microcomputer 40 detects the ON signal, the timers T1, T2 and T3 start counting time. The timers T1 through T8 are set for various periods of time corresponding to the operation periods of the image forming mechanism, the drive mechanism for the separating claw 15, the feeding mechanism for the copy paper sheets, the image transferring mechanism and the paper transporting mechanism E respectively. The data representing the periods of time are included in the program stored in the ROM.

In the step S1, the standard timer T0 operates to convert the reference pulse fed from the pulse generator PG1 into a control pulse train synchronized with the pulse fed from the pulse generator PG2. The respective timers T1 through T8 operate to count the number of the control pulses to cause the timers to synchronize with the operation speed of the drive mechanism of the copying machine.

In the step S2, the state of the switch SW1 is sensed and the operation of the program advances to the step S3 where the switch SW1 is ON.

In the step S3, the timer T1 is set for the period of time t1 corresponding to the period for starting the transfer charger 14, the timer T2 being set for the period of time t2 for starting the separating claw 15. Both of the times counted by the timers T1 and T2 are synchronized with the position of the leading edge of the copying paper sheet transported in the predetermined path in the copying machine. The timer T3 is set for the period of time corresponding to the size of the copy paper sheet selected for making a copy in response to the information fed from the size detecting device. The step S3 comprises sub routines S3′ and S3″ for selecting of the paper sizes A3, A4 and A5 and for setting the timer T3 for the period of time indicative of the selected paper size.

In the step S4, it is sensed whether or not the timer T1 has completed the counting of the period of time t1, and in turn transfer charger 14 begins to operate when the period of time t1 assigned to the timer T1 has elapsed.

In the step S6, the jam detecting circuit JAML provided in the interface IF senses whether or not the copy paper sheet is present at the position P1, by sensing whether the state of the input terminal $I_A$ is "1" or "0" during the period FT1 (see FIG. 10), which state is decided by the state of the output of the detector 50-1.

Figure 10:
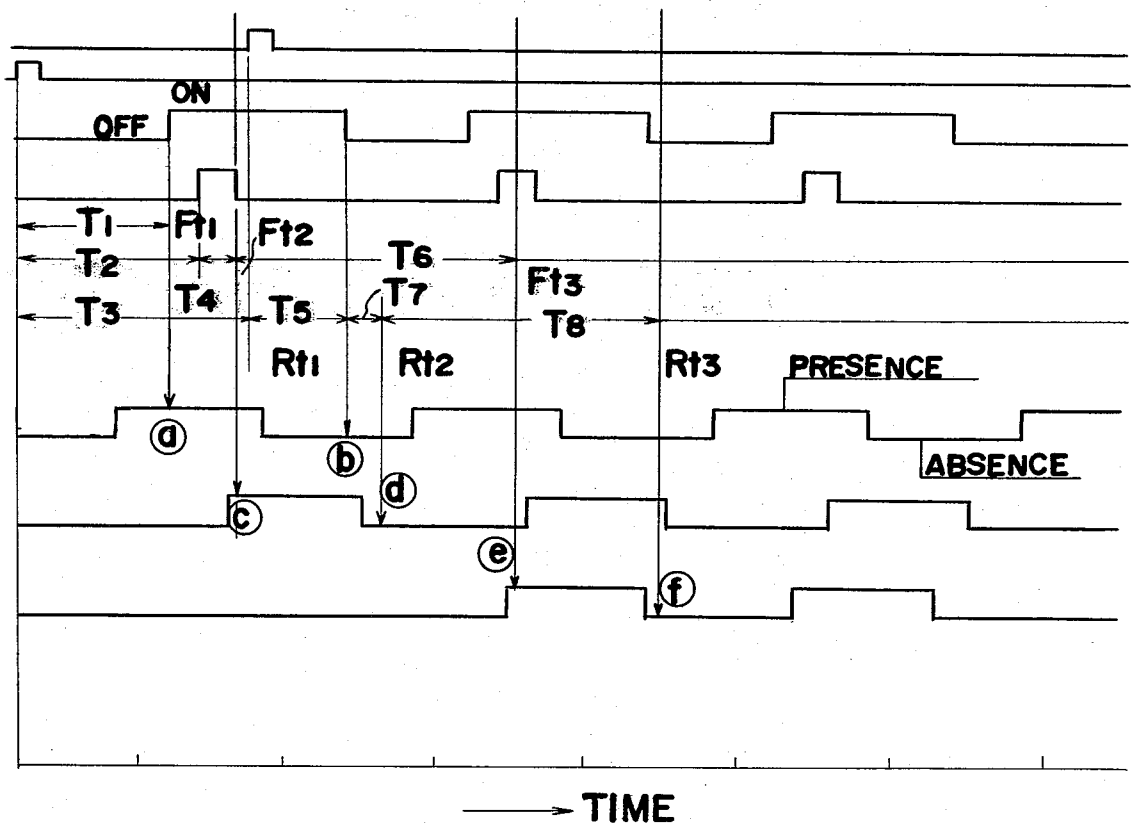
FIG. 10 is a time chart showing various operation periods of the paper detectors employed in the embodiment of the paper jam detecting device according to the present invention.

The "1" state shown at (a) in FIG. 10 represents an output of the detector 50-1 indicating the presence of the copy paper sheet at the position P1.

When the detector 50-1 detects the presence of the leading edge of the copy paper sheet, the operation advances to the step S7 to sense the state of the timer T2. On the other hand, when the detector 50-1 detects no copy paper sheet, the operation advances to the step S29, thereby causing the paper jam display (not shown) to be illuminated and the copying machine to stop.

In the step S6 the jam detecting circuit JAML senses the state of the terminal $I_A$ in the time RT1 (see FIG. 10).

If the "1" state is sensed at the terminal $I_A$, the jam detecting circuit JAML detects a paper jam occuring at the position P1, or in the vicinity thereof.

A paper jam occuring in either of the positions P2 or P3 can be detected in a manner similar to that described above in the steps S19 or S24 in the respective times FT2, FT3, RT2 and RT3 by sensing the state of the terminals $I_B$ or $I_C$ by means of the paper jam detecting circuit JAML in response to the signals fed from the paper detector 50-2 or 50-3.

Referring to FIGS. 11A and 11B again, in the step S7, the state of the timer T2 is sensed. If the period of time t2 assigned to the timer T2 has elapsed in this step, the separating claw 15 starts to separate the copy paper sheet P from the drum 10, and in turn, the timer T4 is set with the period of time t4 in the step S8.

In the step S9, the state of the timer T3 which is set for the period of time corresponding to the size of the copy paper sheet P is sensed, thereby causing the timer T5 to start in the step S10 when the period of time t3 has elapsed.

In the step S11, the state of the timer T4 set in the step S8 is sensed, and if the period of time t4 has elapsed, the operation advances to the step S12 wherein the state of the input terminal $I_B$ is sensed in order to detect whether or not a paper jam has occurred in the vicinity of the position P2.

In the step S13, separating claw 15 is stopped and the timer T6 starts to count the period of time t6 for generation of the instructions to sense the state of the output of the paper detector 50-3.

In the step S14, the state of the timer T5 which started in the step S10 is sensed, and if the period of time t5 has elapsed, the transfer charger 14 stops in the step S15.

In turn, the step S16, a paper jam occuring in the vicinity of the position P1 is detected by detecting the trailing edge of the paper. In the step S17 the timer T7 starts to count the period of time t7, the output of the timer T7 is used as a timing signal to start the operation of the detector 50-2.

In the step S18, the state of the timer T7 is sensed and if the period of time t7 has elapsed, the state of the input terminal $I_B$ is sensed to detect if trailing edge of the copy paper sheet is present in the position P2 by means of the paper detector 50-2. If no trailing edge of the copy paper sheet is detected in the position P2, the timer T8 starts in the step S20.

In the step S21, the state of the timer T6 is sensed. If the period of time t6 has elapsed, the state of the input terminal $I_C$ is sensed so as to detect whether or not the copy paper sheet P is present at the position P3 in accordance with the signal fed from the detector 50-3 in the step S22. If the presence of the copy paper sheet P is detected, the operation advances to the step S23.

In the step S23, the state of the timer T8 is sensed. In the step S24, whether or not the trailing edge of the copy paper sheet P is present in the vicinity of the position P3 is sensed.

The step S25 represents various steps of sensing and processes performed during one routine of the program.

In the step S26, a determination is made whether or not the standard timer T0 has counted the period of time t0.

The length of time of one routine is selected to be within 1–10 milliseconds in correspondence with the period of one routine of the program performed by the microcomputer. In the step S27 a determination is made whether the copying machine is operating. Where the machine is operating, the operation advances to the step S28, wherein the operation of the program pauses until generation of the pulse pg2 fed from the pulse generator PG2 synchronized with the motion of the copying machine. After the detection of the pulse pg2, the operation returns to the step $S_A$.

It is noted that a period of one routine of a microcomputer can be defined accurately, whereas the speed of the drive system of the copying machine may change due to a voltage fluctuation in the electric power supply and/or mechanical error. Accordingly, deviation between various motions of the mechanical system and the instructions provided by the microcomputer each of which corresponds to the motions of the various part of the mechanical system may occur where the microcomputer is operated only by timing pulses provided therein.

However, as described above in the embodiment of the present invention, the microcomputer is controlled by the timing pulse pg2 synchronized with the motion of the copying machine. This operation facilitates operation of the microcomputer in synchronism with the motion of the copying machine.

A period of one routine of the program, which is set in the standard timer T0, is selected to have a length of time shorter than the minimum period of the pulses pg2.

As apparent from the foregoing, it is not necessary to set the timer T1 through T8 with the times only for defining the periods of paper jam detection. For example, the time t1 assigned to the timer T1 is also used for defining the period of starting of the transfer charger 14, the time t2 assigned to the timer T2 is also used for defining the period of starting of the separation claw 15 and the time t5 assigned to the timer T5 is also used for defining the period of stopping the transfer charger 14.

Accordingly, according to the present invention the program stored in the microcomputer does not become complicated for performing the detection of paper jam.

It is an advantage of the present invention that the period of time defined by the timer T5 for stopping the transfer charger 14 is varied automatically in accordance with the size of the copying paper sheet so that the transfer charger 14 operates only within required period of time.

Accordingly, the period of time set in the timer T3 in accordance with the paper size, detection is effectively used not only for the paper jam but also for other purposes.

What is claimed is:

1. A paper jam detecting device for use in an electrophotographic copying machine including means for starting the copying operation thereof, said device comprising:

paper detecting means for detecting the presence or absence of the copy paper at at least one predetermined position in a path along which the copy paper moves, means for detecting the size of copy paper used in the copy process.

feeding means for feeding the copy paper from a supply of copy paper to said path, means connected to said feeding means for driving said feeding means in response to the operation of the copying operation starting means, first timer means and second timer means adapted to count predetermined periods of time, said first timer means being set for a period of time corresponding to the period starting from the beginning of the motion of the copy paper and ending on arrival of the leading edge of the copy paper at a position corresponding to the paper detecting means, means connected to said size detecting means for converting the paper size information fed from the size detecting means into time data information, means connected to said converting means and said second timer means for setting the time data information in the second timer means, and means connected to said paper detecting means and said respective timer means for judging the state of the output of the paper detecting means in response to the instructions provided by the first timer means or the second timer means so as to generate signals indicative of a paper jam if no paper is detected when the first timer means has completed the counting of the period of time set in the first timer means and if paper is detected when the second timer means has completed the counting of the period of time set in the second timer means.

2. A paper jam detecting device according to claim 1, further comprising pulse generating means connected to said first and second timer means, and the respective first timer means and the second timer means are digital timers which count the number of pulses fed from the pulse generating means.

3. A paper jam detecting device according to claim 1, wherein said converting means comprises means for storing a plurality of time periods each of which corresponds to the size of one of the sizes of copy paper supplied to the copying machine and for supplying one of the time periods to the second timer means in accordance with the information supplied from said paper size detecting means.

4. A paper jam detecting device according to claim 3, wherein there is a plurality of paper detecting means with the respective paper detecting means disposed at a plurality of positions located along the copy paper path, the first timer means including a plurality of timers for generation of signals indicative of periods of time it takes the leading edge of the copy paper to reach the positions of the respective paper detecting means, and the second timer means including a plurality of timers for generation of signals indicative of periods of time it takes the trailing edge of the copy paper to reach the respective positions of said paper detecting means.

5. In an electrophotographic copying machine the combination comprising:

paper detecting means for detecting the presence or absence of the copy paper at at least one predetermined position in a path along which the copy paper moves, means for starting the copy process, means for detecting the size of copy paper used in the copy process, feeding means for feeding the copy paper from a supply of copy paper to said path, means connected to said feeding means for driving said feeding means in response to the operation of the copy process starting means, control means for controlling the operation of the copying machine sequentially in accordance with a control program stored therein and to which said paper size detecting means is connected, pulse generating means connected to said control means for generating a pulse train used as standard pulses for operating the control means, first and second digital timer means connected to said control means for counting periods of time to generate signals showing that the periods of time have elapsed by counting the number of said standard pulses, means connected to said first and second digital timer means for synchronizing the starting of the operation of the first and second digital timer means with the motion of the copying machine, said first digital timer means being set with digital data corresponding to the period of time it takes the leading edge of the copy paper transported in accordance with the operation of the copy process to reach the position of the paper detecting means, converting means provided in the control means for converting the paper size detected by said paper size detecting means into digital data for a number of pulses corresponding to the time it takes the trailing edge of the detected paper size to reach the position of the paper detecting means and setting the pulses in the second digital timer means, and means connected to said paper detecting means and said first and second digital timer means for sensing the state of the output of the paper detecting means in response to the instructions provided by the first digital timer means or the second digital timer means so as to generate signals indicative of a paper jam if no paper is detected when the first digital timer means has completed counting of the period of time set in the first timer means and if paper is detected when the second digital timer means has completed counting of the period of time set in the second timer means.

6. The combination according to claim 5, wherein said converting means comprises storing means for storing a plurality of times each of which corresponds to a size of the copy paper supplied to the copying machine and for supplying digital data for one of the times to the timer means in response to the paper size detected by said paper size detecting means.

7. The combination according to claim 5, wherein the paper detecting means comprises a plurality of detectors disposed at a plurality of positions along the copy paper path, the first digital timer means having a plurality of timers for generation of signals indicative of the periods of time it takes the leading edge of the copy paper to reach the positions corresponding to the respective paper detectors, and the second digital timer means having a plurality of timers for generation of signals indicative of the periods of time it takes the trailing edge of the copy paper to reach the positions of the respective detectors.

* * * * *